United States Patent [19]

Huber

[11] Patent Number: 5,033,510

[45] Date of Patent: Jul. 23, 1991

[54] REMOVABLE ISOLATION BAFFLE FOR WASTEWATER CONDUIT

[76] Inventor: Donald G. Huber, P.O. Box 64160, Tacoma, Wash. 98464

[21] Appl. No.: 577,054

[22] Filed: Aug. 31, 1990

Related U.S. Application Data

[63] Continuation of Ser. No. 322,721, Mar. 13, 1989, abandoned, which is a continuation-in-part of Ser. No. 190,591, May 5, 1991, Pat. No. 4,936,350.

[51] Int. Cl.[5] ..... F16K 7/00

[52] U.S. Cl. ..... 138/90; 137/68.1; 251/294

[58] Field of Search ..... 251/294, 339; 137/67, 137/68.1, 797; 138/89, 90, 92, 49.8

[56] References Cited

U.S. PATENT DOCUMENTS 4,602,504 7/1986 Barber ..... 138/89 X

*Primary Examiner*—John C. Fox

*Attorney, Agent, or Firm*—David L. Garrison; Paul L. Griffiths

[57] ABSTRACT

A conduit isolation baffle assembly designed to be installed in a conduit system such as a vent and wastewater system of a building. The flexible baffle is installed in a groove having a sidewall and seat formed in the interior surface of a conduit to isolate the system for testing. Once the testing procedures are complete, the baffle is flexed into a saddle shape so that it is removable from the conduit without disassembly.

5 Claims, 2 Drawing Sheets

REMOVABLE ISOLATION BAFFLE FOR WASTEWATER CONDUIT

This is a continuation of application Ser. No. 07/322,721 filed on Mar. 13, 1989, abandoned, which is a continuation-in-part of Ser. No. 07/190,591 filed May 5, 1971, now U.S. Pat. No. 4,936,350.

TECHNICAL FIELD

This invention relates to a vent and wastewater conduit isolation assembly designed to be installed within the vent and wastewater drainage system of a building. More particularly, this invention relates to a conduit isolation baffle assembly designed to be installed between a wastewater line from a newly constructed or repaired building and a sewage service line, thereby isolating the wastewater line or a portion thereof from the sewage service line during construction, but which can be easily removed from the wastewater line after testing for leaks, without disassembly of the wastewater conduit.

BACKGROUND ART

In housing construction, a newly installed or repaired vent and wastewater system must remain isolated from the sewage service line until the plumbing construction is inspected and certified. It is common practice within the construction industry to place an outlet end of a newly installed wastewater line of the building near an inlet to a sewage service line. At this point in construction, these two lines are not connected. Where these two lines would otherwise meet, each line is capped-off until testing and inspection is complete. Usual construction techniques often require that the connection site be buried before the tests are performed. After the testing and inspection is complete, the connection site is re-excavated and a proper connection of the two lines is made.

Various patents have been issued with respect to test or isolation valve assemblies.

Sullivan (U.S. Pat. No. 4,429,568) discloses a closure plug for pressure testing a liquid drain and vent plumbing type system. Sullivan uses a cleanout Y for access to open the plug plate assembly.

Cohen (U.S. Pat. No. 1,720,819) discloses a test T having a tapered gate which closes off a house drain pipe from a drainage system. After the test has been completed, the gate is removed from the test T and the resulting opening in the tee is closed by a cover plate.

Tagliarnio (U.S. Pat. No. 4,542,642) discloses a test tee having a plug which is a removable blocking disk. The blocking disk engages a ledge in the test tee and seals the drainage system. The disk is accessible and removable through an access means.

Roberson (U.S. Pat. No. 4,658,861) discloses a pneumatic plug inserted through a cleanout T to block off a house service line to a main sewer line.

Kennedy (U.S. Pat. No. 1,948,220) discloses a test plumbing system using a flap valve which is pivoted at an upper side of a valve seat. The flap valve is held in position by a valve adjusting rod.

Barber (U.S. Pat. No. 4,602,504 and U.S. Pat. No. 4,706,482) discloses a device and method for pressure testing pipe and fitting systems in which a frangible seal disk having a removable central portion is permanently attached to the inside of a fitting placed inside a pipe section to be tested thereby blocking fluid flow. After testing, the frangible portion of the sealing disk is removed to permit fluid flow through the seal.

Mayfield, et al. (U.S. Pat. No. 4,142,371) describes a closure apparatus for tubular members in which a seal has a flexible inlay spirally imbedded therein which is torn away to destroy the seal of the structure to the conduit.

The invention described below improves upon the operation of the many prior devices described above in that it permits pressure testing of the wastewater conduits in which it is installed yet is readily removed completely from the conduit after the test is completed without the need for time consuming disassembly of the vent and wastewater conduit assemblies and without the need to reconnect the wastewater conduit to the sewer service line to commence service.

DISCLOSURE OF INVENTION

It is the general object of the present invention to provide a secure but removable closure means for a vent and wastewater drainage system of a building which may be used for isolation and testing purposes.

A further object is to provide a simplified vent and wastewater system isolation valve assembly having a gasket and a removable sealing baffle located between an operating wastewater line of a building and a sewage service line of a public or private sewer system.

A still further object is to provide an isolation baffle assembly which may be held in position at or near the connection between a wastewater line and a sewage service line.

Another object is to provide a flexible isolation baffle having sufficient strength and resiliency to resist the hydraulic test pressure applied to the vent and wastewater drainage system of the building during construction and testing procedures, yet be easily removed through a conduit having an interior diameter less than the outside diameter of the baffle.

Another object is to provide an isolation baffle assembly which may be easily and quickly installed within the vent and wastewater drainage system of a building.

Another object is to provide a means of isolating certain parts of a large vent and wastewater system, such as the upper floors of a multi-story building, in a manner that does not require disassembly of the plumbing system to remove the isolation valve.

SUMMARY

The present invention is a vent and wastewater system isolation baffle assembly designed to be installed within a vent and wastewater drainage system of a building. The isolation baffle assembly may be used to isolate a wastewater line from a sewage service line.

This invention is particularly well adapted for use in residential buildings having a vent and wastewater drainage system, wherein the newly constructed wastewater line must be isolated from the sewage service line during construction and testing operations. Many building codes require that newly constructed or repaired vent and wastewater systems of a building be isolated from the sewage service line during construction, repair, testing, and inspection procedures. Where a vent and wastewater system and prior art practices are being used, the ends, which would otherwise be joined to form the connection between the wastewater line of the building and the sewage service line, are usually separately capped or plugged and buried. After the inspection and pressure testing of the drainage system is complete, the connection site is unearthed, the caps or plugs are removed, the connection is completed, and the connection site is then reburied. This invention eliminates the need to cap the ends of the sewage line and sewage service line prior to testing. This invention also eliminates the need to unearth the connection site to reconnect the lines after the test is completed.

As is described in detail below, a removable baffle is installed within the conduit to isolate the sewer line from the vent and wastewater system of the building. The isolation baffle is a substantially circular disc which may be flat or formed with a convex surface such as a dome, conical or part spherical configuration, the convex surface preferably being positioned toward the vent and wastewater system. A gasket may be advantageously used in conjunction with the baffle to aid in forming a seal with the conduit in which the baffle is positioned, however the baffle may be used without a gasket if an adequate seal is formed with the conduit. The gasket is appropriately shaped and dimensioned to allow for a secure, sealed fitting with a seat formed in the conduit interior surface. The inside surface of the conduit is relieved or machined out to form an enlarged diameter seat to receive the baffle or the baffle and the gasket, if one is used. For example an interior circumfrential groove may be cut into the interior wall of a conduit segment to form the seat to receive the baffle or baffle and gasket assembly. This conduit segment with the baffle mounted in place within the seat may be conveniently used as an element in the construction of the vent and wastewater system with the outlet end thereof connected to the sewage service line. The gasket may be secured within the conduit segment with an adhesive or by shaping or dimensioning the gasket in such a way as to enable the assembly to be lodged securely within a grooved seat means.

The baffle may be formed separately and attached to the gasket, or molded as an integral or removable part thereof. The baffle provides a barrier or closure means to isolate the wastewater conduit from the sewage service line during construction and testing.

The removal means may comprise a line or cord which is attached to the baffle and is operated by pulling to remove the baffle from the conduit. The removal means may extend from the shut-off baffle along the sewer drainage system to exit or be located near an access or cleanout port. Alternatively, a hook or other suitable tool may be used to engage and remove the baffle through an adjacent cleanout port.

The isolation baffle is appropriately shaped and dimensioned to seal the conduit and resist the hydraulic pressures exerted during construction and testing procedures. The baffle is also appropriately shaped and dimensioned to allow little or no resistance to hydraulic flow within the sewer drainage system once the shut-off baffle and removal means have been removed. The baffle has an outer diameter exceeding the inner diameter of the conduit and is positioned in the seat or groove cut into the conduit. The baffle is sufficiently flexible so that it may be formed into a curved or substantially saddle shape during removal so as to allow for easy removal of the baffle from the sewage system after the testing has been performed.

BEST MODE FOR CARRYING OUT THE INVENTION

Figure 1:
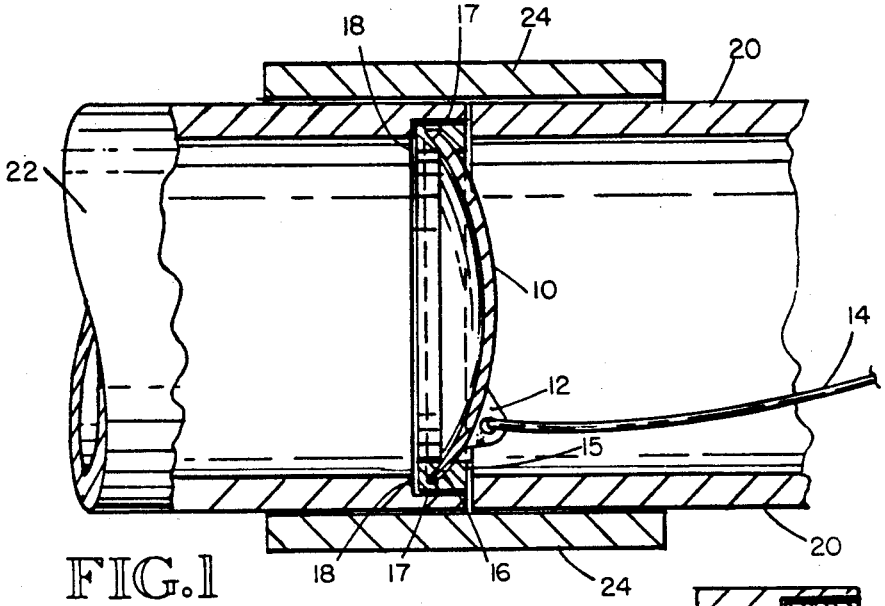
FIG. 1 is a side elevational view, partly in section, of one embodiment of this invention.
Figure 1A:
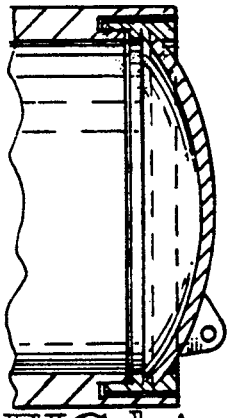
FIG. 1A is a side elevational view, partly in section of a sixth embodiment of this invention.

Referring particularly to the drawings wherein like numerals indicate like parts, there is seen in FIGS. 1-6 various embodiments of the device of this invention. In FIG. 1*a* wastewater system isolation baffle assembly is shown installed for use in the connection between sewage service line or outlet conduit 22 and wastewater conduit 20, shown connected by coupling 24. A cylindrical recess is shown cut into the interior of the end of sewage service line 22 forming a gasket wall 17 and gasket seat 18. The gasket wall 17 is sized and adapted to receive gasket 15 which in turn receives the periphery of baffle 10 in groove 16. In the embodiment shown in FIG. 1, baffle 10 assumes a dome shaped or part spherical shape to enhance the pressure resistant properties thereof. An ear 12 is molded into or attached to baffle 10 to which a removal cord 14 is attached. When installed as shown, the dome shaped baffle 10 and gasket 15 are captured between the proximal end 23 of wastewater conduit 20 and the gasket seat 18. A seal is formed so that pressure applied in the fluid contained in wastewater conduit 20 forces the dome shaped baffle 10 and gasket 15 snugly into a sealing relationship with outlet conduit 22. Baffle 10 is constructed of a flexible material such as any of several well known plastic materials with sufficient rigidity to block and hold any pressure normally encountered in a wastewater conduit, yet is sufficiently flexible to permit removal by a steady pull on the removal cord 14. The baffle may also be constructed of a suitable metal or other material having sufficient strength and flexibility to perform as described. The outer diameter of baffle 10, as seen in FIG. 1, exceeds the inside diameter of wastewater conduit 20 and due to the flexibility of baffle 10, it may be removed from its operative position as shown through the interior of wastewater conduit 20 by continued pulling on the removal cord 14. Gasket 15 may either remain in the position shown or may be removed with the baffle 10 as desired.

Figure 2:
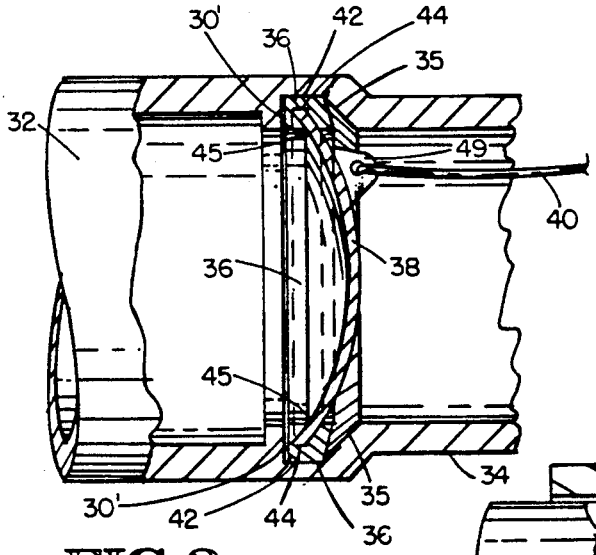
FIG. 2 is a side elevational view, partly in section, of a second embodiment of this invention.

A second embodiment of the invention is shown in FIG. 2 in which a cast or molded conduit segment 33 is formed with inlet portion 34 at one end and outlet portion 32 at the opposite end. Positioned between the inlet and outlet conduits is an interior groove defined by wall 42 and gasket seat 30. Gasket 36 is placed with the baffle periphery 44 in gasket groove 45. Fluid pressure in inlet conduit 34 forces dome shaped baffle 38 into the gasket 36 thereby forming a seal against seat 30. Removal cord 40 is attached to ear 49 which in turn is molded as a part of and extends outwardly from the surface of baffle 38. Pulling on the removal cord 40 causes the baffle 38 to be displaced from gasket groove 45 and baffle 38, being of a flexible material, is deformed into a saddle shape which will readily traverse through the interior of inlet conduit 34 for removal, even though the normal outer diameter of baffle 38 exceeds the inside diameter of segment 34. A chamfered surface 35 may be cut into segment 34 to aid in removal of the baffle 38.

Figure 3:
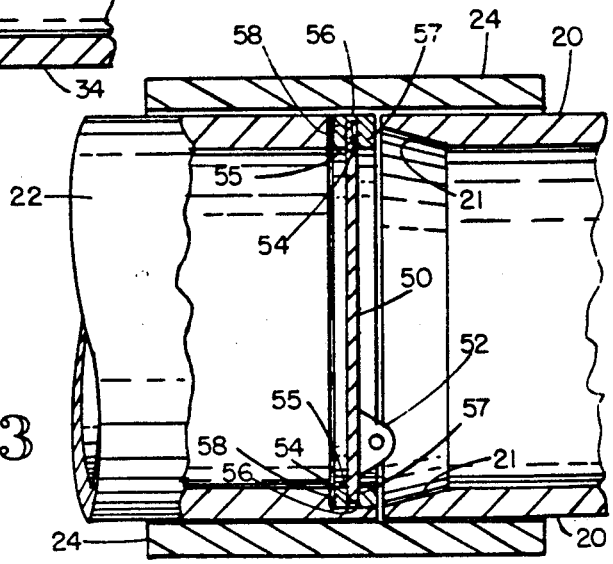
FIG. 3 is a side elevational view, partly in section, of a third embodiment of this invention.

A planar baffle 50 is shown installed in its operative position in the apparatus shown in FIG. 3. Here, sewage service line 22 is shown with an interior cylindrical groove forming a gasket groove sidewall 56. Gasket 55 is adapted to receive the periphery 54 of planar baffle 50 and abuts against gasket seat 58 to form a seal. Wastewater conduit 20 is shown coupled to sewage service line 22 with coupling 24, and may include chamfer 21 to aid in the removal of baffle 50. An embossment 52 is provided on the surface of baffle 50 for removal of baffle 50 from its position shown in FIG. 3.

Figure 4:
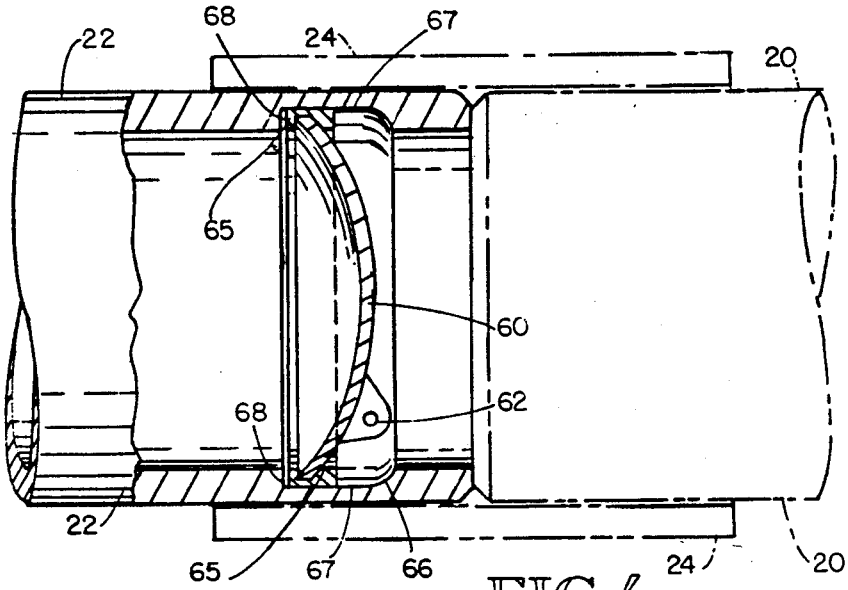
FIG. 4 is a side elevational view, partly in section, of a fourth embodiment of the present invention.

A domed baffle structure much like that shown in FIG. 1 is seen in FIG. 4 in which the domed baffle 60 is shown positioned in gasket 65. The gasket receiving groove forming gasket groove sidewall 67 and seat 68 is shown cut out of the interior of conduit segment 61 near the coupled end 63 thereof and is provided with a sloping or chamfered surface 66 to permit removal of the domed baffle 60 by flexing and pulling of the baffle from its gasket by an implement or cord attached to embossment 62. The baffle 60 is installed and removed by flexing into a saddle shape so that it may pass through conduit segments 61 and 20.

Figure 5:
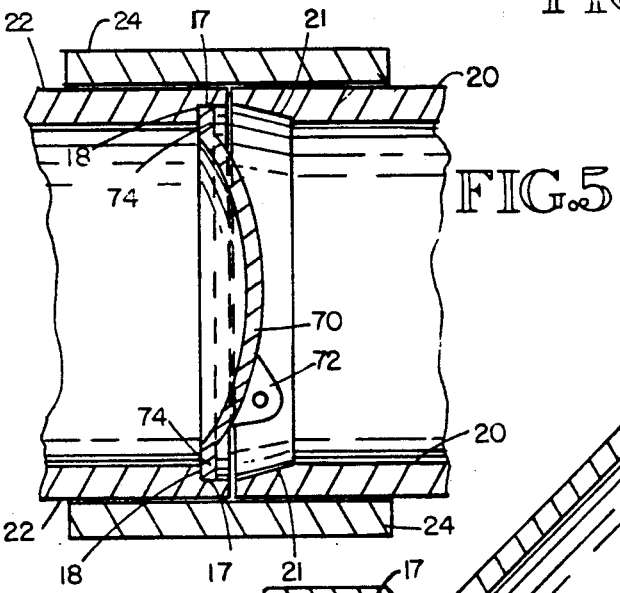
FIG. 5 is a side elevational view, partly in section, of a fifth embodiment of this invention.

In the event a structure is needed in which the baffle is self-sealing without the use of a gasket, the apparatus shown in FIG. 5 may be utilized. Self-sealing dome shaped baffle 70 is shown positioned at groove sidewall 17 against seat 18 formed in conduit 22. An inlet conduit 20 is shown coupled to conduit 22 with coupling 24. The interior of conduit 20 may be formed with chamfer 21 to aid in the removal of baffle 70 by pulling upon ear 72. Again, the flexible nature of baffle 70 permits its removal through the interior of a conduit 20 having an interior diameter smaller that the peripheral diameter of baffle 70. For the device as shown in FIG. 5 integral seal means 74 is formed as a part of the baffle 70 and is used to form a seal with sidewall 17 and seat 18, obviating the need for a gasket in this embodiment. Modifications within the skill of artisans in this art, based upon the invention herein will be apparent so that the gasketless structure can be adapted to the seat structures shown in the other embodiments of this invention and their equivalents.

Figure 6:
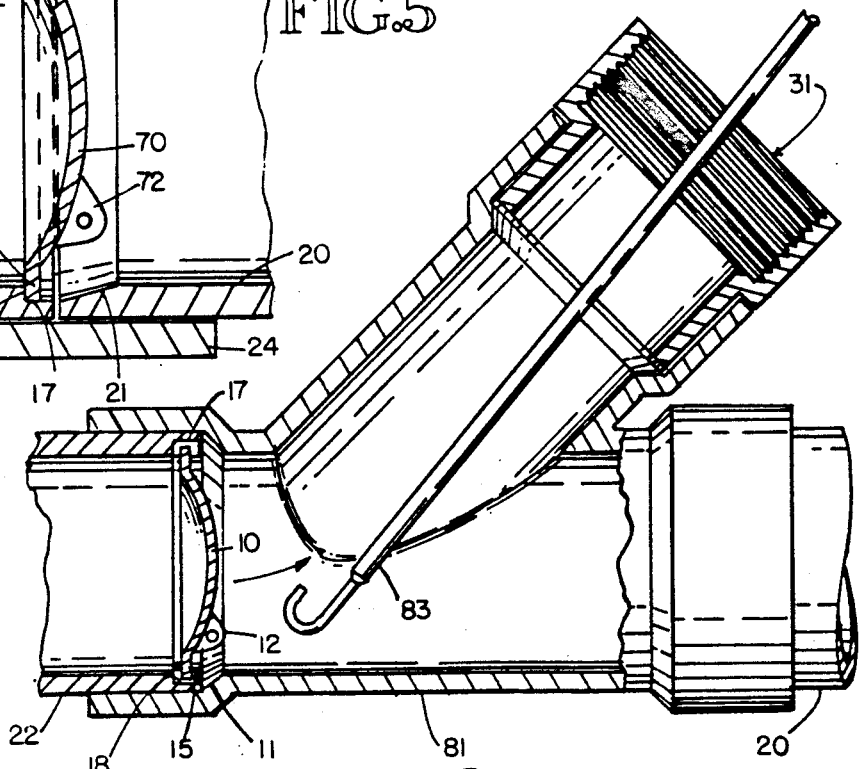
FIG. 6 is a side elevational view, partly in section, of a the apparatus shown in FIG. 1 installed adjacent a conduit cleanout port.

In FIG. 6 the apparatus shown in FIG. 1 is positioned in a location adjacent a cleanout 81 with access port 31 shown open to the atmosphere. A tool 83 is shown extending downwardly into the interior of the cleanout 81 in preparation for engagement with ear 12 for removal of baffle 10 from its operative position in the seat 17. By engaging tool 83 in embossment 12 and firmly pulling, an operator may readily displace baffle 10 from its position shown in FIG. 6 and remove the baffle through cleanout 81 whereupon the cleanout access port 31 may be closed by a threaded plug. With minor modifications, any of the embodiments shown in FIGS. 2–5 and equivalents thereof may be substituted for the embodiments shown in FIG. 6 with equally good results.

An alternative gasket configuration is shown in FIG. 1*a* in which gasket 80 is shown formed with a baffle receiving slot 81 adapted to receive the dome shaped baffle as shown. The gasket receiving groove is formed by sidewall 82, seat 83 and undercut groove 84. An extension 85 of gasket 80 extends into undercut groove 84 to provide additional seal and gasket retention. The apparatus shown in FIG. 1*a* may be substituted for any of the devices as shown in FIGS. 1–6, assuming the undercut groove as shown can be formed as a part of the gasket groove.

In operation, the devices described above are first installed in a conduit segment as shown in the various drawings which may be the sewage service line or an intermediate location in a vent and wastewater system. A section of conduit having an appropriate gasket seat formed therein is installed in the system with the isolation baffle in its operational location, as shown in the several drawings. The conduit is then securely plumbed into the system such as by a coupling or by use of a cleanout 81. The system is then completed and all cleanout ports closed in preparation for pressure testing of the system. The vent and wastewater system upstream of the isolation baffle is then partially or completely filled with water. Pressure may then be applied to aid in the observation of any leaks which may occur. If the system is leak free, the water may be partially or completely removed from the system such as through an access port or cleanout and the isolation baffle is then removed by pulling on a removal cord or by engaging an ear with a removal tool. The baffle is then pulled out through a cleanout or to another location through the conduit by a removal cord. The system is then in operational condition without need to further re-connect the conduit sections.

INDUSTRIAL APPLICABILITY

This invention finds application in the isolation of and interconnection conduits such as vent and wastewater systems to sewer service lines where pressure testing of the upstream portion of the system is required or useful. The apparatus of this invention may also be used in the isolation during construction of various portions of a vent and wastewater system in a large building.

In compliance with the statute, the invention has been described in language more or less specific as to structural features. It is to be understood, however, that the invention is not limited to the specific features shown, since the means and construction herein disclosed comprise a preferred form of putting the invention to effect. The invention is, therefore, claimed in any of its forms or modifications within the legitimate and valid scope of the appended claims, appropriately interpreted in accordance with the doctrine of equivalents.

I claim:

1. A wastewater conduit isolation baffle assembly comprising:

a conduit segment adapted for incorporation into a conduit system with an inside diameter and interior surface, said segment having an interior seat circumferentially disposed into said interior surface of said segment to receive an isolation baffle in a fluid tight sealing relationship, said seat having a diameter greater than said inside diameter of said segment, said seat being adjacent one end of said segment and said one end being adapted to receive coupling means for coupling to an inlet conduit, said inlet conduit having an inside diameter substantially equal to the inside diameter of said conduit segment; and an isolation baffle received in said interior seat, said baffle having a convex central dome, having a diameter exceeding said inside diameter of said conduit segment and being flexible whereby said baffle may be flexed for removal from said assembly and completely removed through said inlet conduit without leaving any portion of said isolation baffle within said conduit system.

2. The apparatus of claim 1 further including gasket means providing a seal between said baffle and said seat.

3. The apparatus of claim 1 wherein said seat is positioned at the end of said segment whereby said baffle may slide easily into said seat.

4. The apparatus of claim 1 wherein said convex central dome extends toward said wastewater conduit.

5. The apparatus of claim 1 wherein said interior seat is formed in a connection, said connection being created by said coupling of said conduit segment to said inlet conduit.

* * * * *